United States Patent [19]

Shull

[11] 4,305,377

[45] Dec. 15, 1981

[54] OPERATING MECHANISM FOR FIREPLACE DAMPER

[76] Inventor: Rodney L. Shull, 8524 W. Arizona Dr., Lakewood, Colo. 80226

[21] Appl. No.: 164,297

[22] Filed: Jun. 30, 1980

[51] Int. Cl.[3] ..... F23L 13/02

[52] U.S. Cl. ..... 126/288

[58] Field of Search ..... 126/288, 285 R, 120, 126/285, 295

[56] References Cited

U.S. PATENT DOCUMENTS

| | | | |
|---|---|---|---|
| 706,182 | 8/1902 | Johnson | 126/288 |
| 926,048 | 6/1909 | Champion | 126/288 |
| 1,928,165 | 9/1933 | Boldt | 126/288 |
| 3,773,029 | 11/1973 | Kent | 126/288 |

*Primary Examiner*—James C. Yeung

*Attorney, Agent, or Firm*—Ralph F. Crandell

[57] ABSTRACT

An operating device for use with a fireplace damper having a depending actuating lever within the firebox area. The operating mechanism extends through the front wall of the fireplace and operatively engaging the damper lever. The mechanism comprises a three section actuating rod which extends through the fireplace wall. A bracket on one end of the rod operatively engages the damper lever. A decorative handle or knob is mounted on the other end of the rod for gripping and for moving said rod inwardly to close the damper and pulling said rod outwardly to open the damper.

1 Claim, 5 Drawing Figures

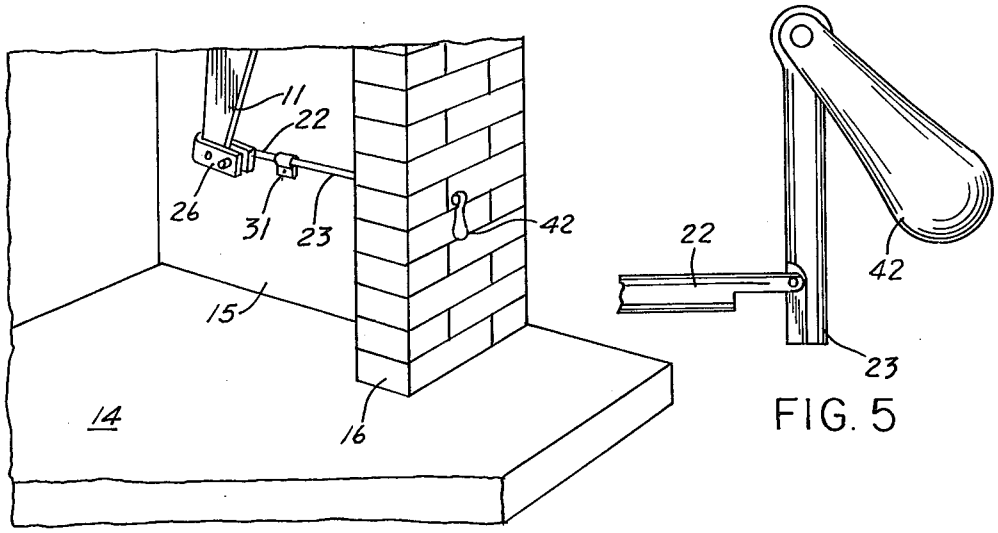
FIG. 5
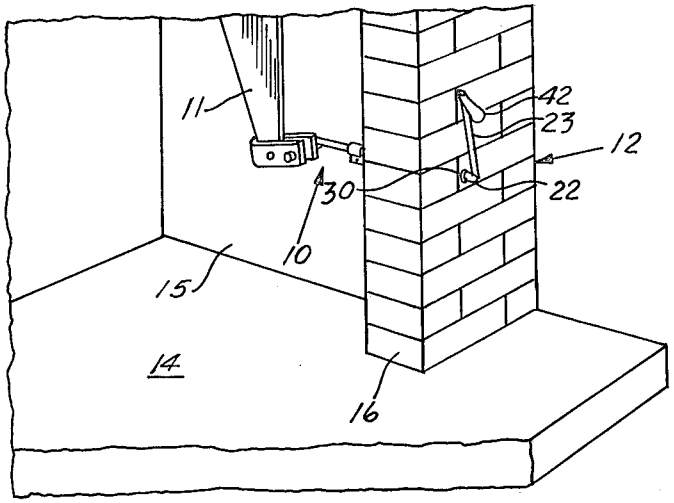
FIG. 2
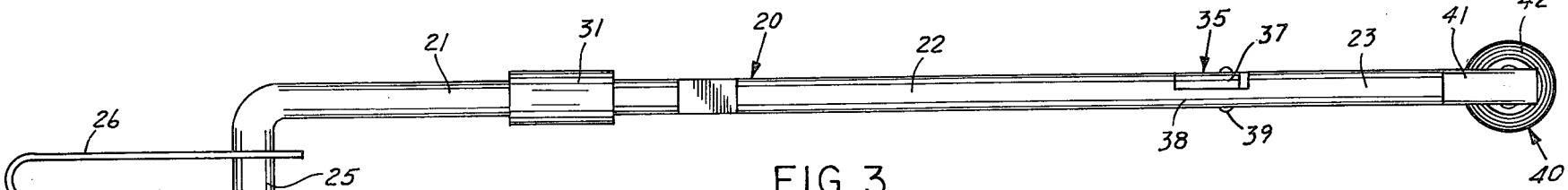
FIG. 1
FIG. 3
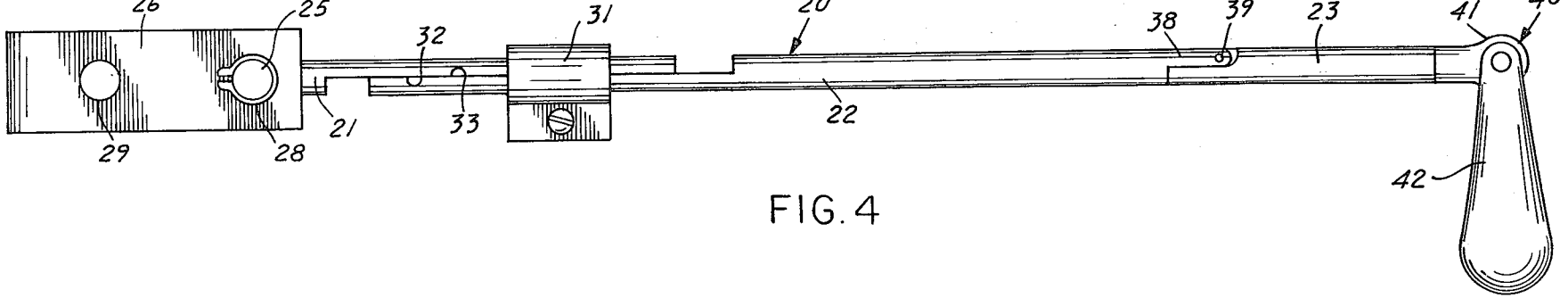
FIG. 4

OPERATING MECHANISM FOR FIREPLACE DAMPER

BACKGROUND OF THE INVENTION

1. Field of the Invention

The present invention relates to fireplace dampers and more particularly to an operating mechanism or device for fireplace dampers.

2. Description of the Prior Art

Fireplace dampers conventionally include an operating lever or arm which depends from the damper within the firebox area of the fireplace. The damper is conventionally closed by moving the arm towards the rear or back firewall of the fireplace, and opened by pulling the damper arm forward towards the fireplace access opening. The damper arms are ordinarily positioned in the upper portion of the fireplace and to one side, and in many installations access to the arm is difficult, requiring the user to bend down and reach into and upwardly in the fireplace. This results in an attendant problem of soot and debris falling on the user, and the possibility that the user will brush a sooty area with his arm or clothing.

OBJECTS AND SUMMARY OF THE INVENTION

It is the principal object of the present invention to provide an improved mechanism for the remote operation of a fireplace damper.

Another object of the present invention is to provide an improved operating mechanism of the foregoing character which extends through the fireplace wall into the room or area in which the fireplace is located.

A further object of the present invention is to provide a fireplace damper operating mechanism which can be readily installed on existing fireplaces and damper without requiring major structural alterations.

A further object of the present invention is to provide a fireplace damper operating mechanism of the foregoing character which, when in use and when the damper is opened, can be positioned in an out-of-the-way resting position to avoid not only an unsightly appearance, but also a hazard to a fireplace screen or to a user placing logs or or combustible materials in the fireplace.

Still a further object of the present invention is to provide an improved operating mechanism which adds a decorative effect to the fireplace.

Other objects and advantages of the present invention will become apparent as the following description proceeds, taken in conjunction with the accompanying drawings.

In accordance with the foregoing objects, there is provided for use with a fireplace damper having a depending actuating lever within the firebox area, an operating mechanism extending through the front wall of the fireplace and operatively engaging the damper lever. The operating mechanism comprises an actuating rod adapted to extend through the fireplace wall and adjustable in length, not only to accommodate different fireplace constructions, but also to facilitate installation. A bracket is provided on the interior or inner end of the actuating rod for engaging the damper lever and may be pinned or otherwise pivotally secured to the operating lever. At its outer end, the rod is provided with a swivel tip or cap to which is pivoted a decorative handle or knob.

A clamp is provided for mounting and holding the actuating rod in an adjusted position. When the damper has been pulled outwardly to open the damper, the rod includes a hinged section which may be raised upwardly against the fireplace wall to position the extending portion of the rod in an out-of-the-way position, yet provide ready access when it is desired to close the damper.

The operating mechanism not only provides for the ready and convenient opening and closing of the damper, but also provides a decorative effect to the fireplace as the knob or handle may be made of an attractively shaped or molded configuration.

It should be further noted that the present invention assists in the conservation of energy, in that the mechanism serves as a clear signal when the fireplace damper is in the open position, thereby alerting the user to close the damper to prevent the loss of heat when the fireplace is not in use.

DESCRIPTION OF THE DRAWINGS

FIG. 1 is a perspective view of a portion of a fireplace showing a damper operating mechanism embodying the present invention and with the damper in the closed position.

FIG. 2 is a fireplace view similar to FIG. 1, but showing the damper in an open position.

FIG. 3 is a plan view of a damper operating mechanism embodying the present invention.

FIG. 4 is an elevation view of a damper operating mechanism embodying the present invention.

FIG. 5 is a partial elevation view of a damper operating mechanism embodying the present invention with the hinge portion thereof swung upwardly as shown in FIG. 2.

DESCRIPTION OF THE PREFERRED EMBODIMENT

The present invention is embodied in an operating mechanism 10, engageable with a damper lever or arm 11 depending from a conventional damper mechanism (not shown) positioned in the flue opening of a fireplace 12. The fireplace is of conventional construction, embodying a hearth 14 and a firebox 15, with a front wall 16 of brick, masonry, or other suitable construction. Conventional fireplace construction further includes a lintel or top wall (not shown) defining with the side walls a fireplace opening surrounding the firebox and damper.

While the damper operating mechanism 10 embodying the present invention is shown mounted on a side front wall of the fireplace, it should be understood that the mechanism can equally well be positioned in the upper wall or lintel. The positioning of the mechanism in the front wall of the fireplace has been shown in the drawings for convenience in illustration only, and the mechanism will generally be mounted in a straight horizontal attitude in the plane of and connectable with the damper lever 11. Those familiar with fireplace construction will be readily able to position the operating mechanism in the most advantageous position.

The damper lever 11 is generally a depending arm which extends downwardly within the fireplace firebox from the damper mechanism. The arm is normally intended to be grasped by the fireplace user and pushed toward the rear of the firebox to close the damper, or pulled towards the front opening of the fireplace to open the damper. The construction of the fireplace, flue and damper mechanism is, of course, conventional and well known in the art.

In order to enable the fireplace user to actuate the damper without reaching into the firebox to grasp the damper lever 11, the present invention contemplates an elongated rod 20 formed with a rear section 21, an intermediate section 22 and a forward section 23, all aligned and coupled as hereinafter described. The rod 20 is coupled with the damper lever in the firebox area and extends out through the front wall 16 of the fireplace. By moving the rod inwardly, the damper lever is thus pushed to the rear to close the damper. Conversely, by pulling on the rod, the damper lever is swung forwardly to open the damper.

In order to engage the damper lever 11, the rear portion 21 of the rod 20 is provided with an L-shaped bend 25 to which is pivotally engaged a U-shaped bracket 26 adapted to be operatively secured to the depending fireplace lever 11. The bracket 26 is provided with an aperture 28 for engaging the turned end 25 of the rod and may be further provided with a pin aperture 29 for providing pinned engagement of the bracket 26 with the damper lever 11. The bracket 26 may be made of sheet metal or of any appropriate construction for secure engagement with the damper lever 11.

In order to provide for adjustment of the length of the rod 20, as well as to facilitate installation of the rod through an appropriate aperture 30 in the fireplace wall 16, the rear and middle portions 21, 22 of the rod are clamped together by an appropriate clamp mechanism 31. In order to provide for sliding adjustable engagement between the rod sections 21, 22 and prevent the rod from twisting, corresponding juxtaposed end portions of the rod sections 21, 22 may be provided with flattened areas 32, 33 respectively, which abut and are clamped together by the clamp 31. Alternatively, the rod section may be threaded together or joined in any other suitable manner. In order to install the rod in the fireplace, the middle rod section 22 is inserted through the aperture 30 in the fireplace wall 16 from the front of the fireplace. When inside the firebox, the rear section 21 of the rod is then clamped to the middle section 22, and the U-bracket is engaged to the damper lever 11. The length of the rod is adjusted according to the fireplace dimensions, and the clamp tightened to secure the rod.

The front portion 23 of the rod is hinged to the middle portion 22 by a one-way hinge construction 35. For this purpose, the juxtaposed ends of the front section 23 and middle rod section 22 are recessed to provide abutting flanges 37, 38 respectively, which are in turn pinned or hinged together by a hinge pin 39. With this construction, the front portion of the rod can be swung upwardly to the position shown in FIGS. 2 and 5. The extending rod portion can thus be positioned out of the way to remove it from both an unsightly position as well as a position in which it might snag clothing or otherwise injure someone near the fireplace.

For grasping and moving the rod in and out, a handle mechanism 40 is provided at the outer end of the front section of the rod 20. One illustrative handle mechanism comprises a threaded or swivel mounting cap 41 threadably or swivelably engaged with the extending end of the outer rod section 23. Pivotally or swingably depending from the mounting cap is a knob or handle 42 which may be decoratively shaped. The handle or knob provides for ease of gripping and moving the rod to operate the damper.

In operation the mechanism forms an actuating rod which extends through the wall of the fireplace and may be pushed inwardly to close the damper or pulled outwardly to open the damper. In the latter position, when the damper has been opened, the forward end of the rod is swung upwardly to an out-of-the-way position as shown in FIGS. 2 and 5. The swivel and knob connection allows the knob to hang downwardly in front or to one side of the rod in an out-of-the-way but decorative position.

While a certain illustrative embodiment of the present invention has been shown in the drawings and described above in considerable detail, it should be understood that there is no intention to limit the invention to the specific form disclosed. On the contrary, the intention is to cover all modifications, alternative constructions, equivalents and uses falling within the spirit and scope of the invention as expressed in the appended claims.

What I claim is:

1. For use with a fireplace damper having a depending actuating lever located within the firebox area above the hearth of a fireplace, an operating mechanism extending through the front wall portion of the fireplace and operatively engaging the damper arm for opening and closing the same, said operating mechanism comprising an elongated three-section actuating rod, two of said rod sections being adjustable with respect to each other for adjusting the length of the rod and for inserting the rod in place in the fireplace wall, the innermost end of one of said rod sections being bent to form a generally L-shaped end portion, a U-shaped bracket mounted on said L-shaped rod portion and engageable with the depending end of the damper actuating lever, a clamp for securing the adjustable sections of the rod together, a one-way hinge swingably engaging the second and third sections of the rod together whereby the third section of the rod can be swung upwardly, a cap pivotally engaged on the forward end of the third rod section, and an actuating knob swingably engaged with said pivoted cap for gripping engagement by a user to slide the rod axially to open and close the damper, said third rod section being swingable upwardly against the fireplace wall when the rod has been pulled to open the damper.

* * * * *